United States Patent [19]

Kyriakou

[11] 3,984,892

[45] Oct. 12, 1976

[54] BRUSH AND SCRAPER HOLDER

[76] Inventor: George S. Kyriakou, 43-43 91st Place, Elmhurst, N.Y. 11373

[22] Filed: Nov. 17, 1975

[21] Appl. No.: 632,262

[52] U.S. Cl. ..... 15/111; 15/144 R

[51] Int. Cl.[2] ..... A46B 17/08; B25G 3/38; B44D 3/16

[58] Field of Search ..... 15/111, 113, 117, 143 A, 15/144 R, 144 B, 146, 172

[56] References Cited

UNITED STATES PATENTS

| | | | |
|---|---|---|---|
| 1,391,018 | 9/1921 | Sohnle | 15/111 X |
| 1,771,325 | 7/1930 | Cotter | 15/111 UX |
| 2,171,444 | 8/1939 | Frank | 15/172 X |
| 2,689,967 | 9/1954 | Mackey | 15/111 X |
| 2,792,581 | 5/1957 | Woyton | 15/144 R |
| 2,824,323 | 2/1958 | Ios et al. | 15/111 X |
| 3,413,043 | 11/1968 | Bertolina | 15/144 R X |

FOREIGN PATENTS OR APPLICATIONS

| | | | |
|---|---|---|---|
| 14,552 | 7/1898 | United Kingdom | 15/111 |

*Primary Examiner*—Daniel Blum
*Attorney, Agent, or Firm*—Richard L. Miller

[57] ABSTRACT

A device for letting a person to reach high up with a brush or scraper when refinishing a ceiling or wall; the device consisting of a long handle which at one end can be held in the hands, and the other end being fitted with a carriage bolt upon which there is mounted both a scraper and a paint brush, the carriage bolt having a shoulder that is either square or hexagonal for being fitted through a correspondingly same shaped opening in the scraper and brush so that these implements can each be independently turned and held in a desired direction such as up, sidewardly or diagonally so to reach a working area.

2 Claims, 4 Drawing Figures

27
29
29
28
21
21
18
10
11

3
3
18
24
26
25
16
11
23
21

18
21
11

26
12
23
24
13
25
19
20
22
17
16
14
15
18

BRUSH AND SCRAPER HOLDER

This invention relates to painters' tools.

A principal object of the present invention is to provide a holder for holding both a conventional paint scraper and a paint brush, and which lets a person to reach with either of them very high up so to refinish a ceiling or a high wall.

Another object is to provide a brush and scraper holder in which each of the implements can be adjusted for individual use, and can be set at various angles in order to reach a desired working area.

Another object accordingly is to provide a brush and scraper holder which allows a person to work from standing on a floor instead on a ladder, so to be particularly ideal for persons, particularly older people, who feel unsafe on ladders to do their own scraping and painting.

Other objects are to provide a brush and scraper holder which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figures 1, 2, 3, 4:
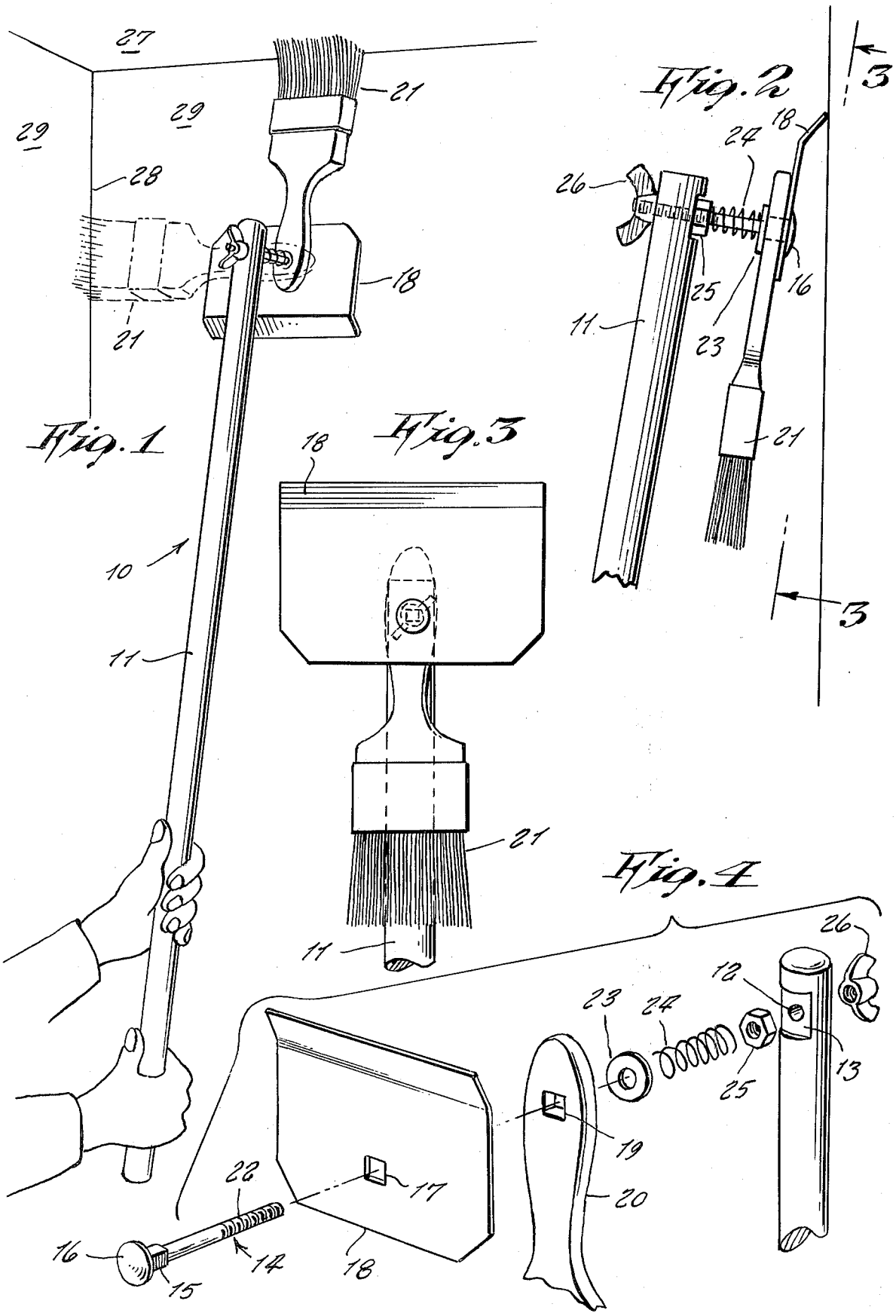
FIG. 1 is a perspective view of the invention shown in operative use.
FIG. 2 is an enlarged detail side edge view thereof with the brush and scraper rotated 180°.
FIG. 3 is a view in direction 3—3 of FIG. 2.
FIG. 4 is an exploded perspective view of the components of the invention.

Referring now to the drawing in detail, the reference numeral 10 represents a brush and scraper holder according to the present invention wherein there is an elongated, straight handle 11 which at one end can be held in a person's hands. The opposite end of the handle has a transverse opening 12 therethrough that opens on a flat face 13 on one side of the handle.

A carriage bolt 14 is shown in the drawing having a square shoulder 15 adjacent an enlarged head 16 for fitting first in a square opening 17 of a scraper blade 18 and then in a square opening 19 of a brush handle 20 of a paint brush 21. The threaded shank 22 of the carriage bolt in succession extends through a washer 23, a coil compression spring 24, a threaded nut 25, the opening

12 of the handle and finally into a threaded wing nut 26.

While the drawing illustrates a square shoulder 15 and correspondingly same shaped openings 17 and 19, it is understood that alternately these could be hexagonal or other shaped, as preferred by a manufacturer.

Thus assembled, the spring applies force to maintain the engagement of the shoulder 15 with the openings 17 and 19 so that the scraper and brush are rigidly held and prevented from rotating around the carriage bolt.

In operative use, as shown in FIGS. 1 and 2, either of the implement 18 or 21 are adjusted on the carriage bolt so to be in an operative position while the other is in a retracted, out-of-the-way position. To readjust the scraper or brush positions, a person needs only to push both implements against the spring so to disengage the openings 17 and 19 from the shoulder, thus allowing the implements to rotate around the shank 22 to any desired direction, and then allow the spring to push the implements back on the shoulder again. Thus as shown, for example, in FIG. 1, the brush can be used vertically upwardly to paint a ceiling 27, or as shown by the dotted lines, to paint a vertical corner 28 of the walls 29.

Thus a useful brush and scraper holder is provided.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In a brush and scraper implement, the combination of an elongated handle, a paint scraper and a brush, and means for adjustably mounting said scraper and brush at one end of said handle, said means comprises a transverse opening through said handle end, a carriage bolt having a polygonal shoulder adjacent an enlarged head being fitted first through a correspondingly polygonal opening of a scraper blade and brush handle of a brush, and then through a washer, a compression coil spring, a threaded nut, said handle transverse opening and a wing nut, the bolt threadedly engaging the nuts, and the scraper and brush being adjustable to different angular positions on the shoulder.

2. The combination as set forth in claim 1 wherein said carriage bolt has a portion between said threaded nut and said washer that is longer than a thickness of said scraper blade and brush handle so to allow sliding of said scraper and brush handle off said shoulder against a force of said spring and around said shank for rotational readjustment thereof.

* * * * *